US008340565B2

(12) United States Patent
Ikezaki

(10) Patent No.: US 8,340,565 B2
(45) Date of Patent: Dec. 25, 2012

(54) IMAGE FORMING DEVICE HAVING DETACHABLE DRUM UNIT

(75) Inventor: Yoshiyuki Ikezaki, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/368,505

(22) Filed: Feb. 8, 2012

(65) Prior Publication Data

US 2012/0141182 A1 Jun. 7, 2012

Related U.S. Application Data

(63) Continuation of application No. 12/359,720, filed on Jan. 26, 2009, now Pat. No. 8,139,996.

(30) Foreign Application Priority Data

Jan. 29, 2008 (JP) ..... 2008-017602

(51) Int. Cl.
*G03G 15/00* (2006.01)

(52) U.S. Cl. ..... 399/395; 399/394

(58) Field of Classification Search ..... 399/395
See application file for complete search history.

(56) References Cited

U.S. PATENT DOCUMENTS

| | | | | |
|---|---|---|---|---|
| 4,657,372 | A | 4/1987 | Ikeda et al. | |
| 5,005,861 | A | 4/1991 | Breed et al. | |
| 5,055,861 | A | 10/1991 | Murayama et al. | |
| 5,444,515 | A * | 8/1995 | Haneda et al. | 399/112 |
| 5,559,590 | A | 9/1996 | Arai et al. | |
| 5,936,651 | A * | 8/1999 | Uchida et al. | 347/104 |
| 5,943,081 | A * | 8/1999 | Uchida et al. | 347/104 |
| 6,226,486 | B1 | 5/2001 | Itou et al. | |
| 6,343,200 | B1 | 1/2002 | Hatano et al. | |
| 6,708,011 | B2 * | 3/2004 | Nomura et al. | 399/110 |
| 6,718,872 | B2 | 4/2004 | Kanno | |
| 7,496,317 | B2 * | 2/2009 | Igarashi et al. | 399/124 |

(Continued)

FOREIGN PATENT DOCUMENTS

JP H03-29947 3/1991

(Continued)

OTHER PUBLICATIONS

Japanese Official Action dated Apr. 27, 2010 in related application 2008-017602 with English language translation.

(Continued)

*Primary Examiner* — Anthony Nguyen
(74) *Attorney, Agent, or Firm* — Scully, Scott, Murphy & Presser, PC

(57) ABSTRACT

An image forming device includes a frame having an opening, a cover for the opening, a drum unit, a belt unit and a pair of registration rollers. The drum unit has a plurality of photosensitive drums defining an axis and being juxtaposed in line in a direction orthogonal to the axis. The belt unit has a plurality of rollers and an endless belt mounted over the plurality of rollers. The drum unit is movable in a first direction and accessible through the opening. The pair of registration rollers nips the recording sheets to correct skew in the recording sheets and to convey each recording sheet toward the belt unit. The pair of registration rollers is disposed at a side opposite to the drum unit. The pair of registration rollers defining a nip point located at a position aligned with the belt unit.

11 Claims, 6 Drawing Sheets

U.S. PATENT DOCUMENTS

| | | | | |
|---|---|---|---|---|
| 7,620,344 | B2 * | 11/2009 | Igarashi | 399/110 |
| 7,778,567 | B2 * | 8/2010 | Igarashi et al. | 399/110 |
| 2003/0053819 | A1 * | 3/2003 | Nomura et al. | 399/110 |
| 2004/0126136 | A1 * | 7/2004 | Toba et al. | 399/114 |
| 2006/0002735 | A1 | 1/2006 | Yasuo et al. | |
| 2006/0067732 | A1 | 3/2006 | Hiroshi | |
| 2006/0067734 | A1 | 3/2006 | Hiroshi et al. | |
| 2006/0079358 | A1 | 4/2006 | Hiroshi | |
| 2006/0180973 | A1 | 8/2006 | Hiroshi | |
| 2007/0048005 | A1 | 3/2007 | Nakano et al. | |
| 2007/0048006 | A1 | 3/2007 | Igarashi et al. | |
| 2007/0059071 | A1 | 3/2007 | Shinshi et al. | |
| 2007/0160382 | A1 | 7/2007 | Tomatsu | |

FOREIGN PATENT DOCUMENTS

| | | | |
|---|---|---|---|
| JP | 5-346741 | | 12/1993 |
| JP | 9-022228 | A | 1/1997 |
| JP | 9-304994 | A | 11/1997 |
| JP | 10-339982 | A | 12/1998 |
| JP | 2001-341890 | | 12/2001 |
| JP | 2006-96527 | | 4/2006 |
| JP | 2006-98772 | | 4/2006 |
| JP | 2006-98776 | | 4/2006 |
| JP | 2006-267668 | A | 10/2006 |
| JP | 2007-057953 | A | 3/2007 |
| JP | 2007-062967 | A | 3/2007 |
| JP | 2007-148142 | A | 6/2007 |

OTHER PUBLICATIONS

Japanese Official Action dated Oct. 12, 2010 in related application 2008-017602 with English language translation.

Japanese Office Action dated Apr. 5, 2011 of related JP Application No. 2010-139668 together with an English translation.

U.S. Official Action dated Jun. 23, 2011 from U.S. Appl. No. 12/359,720.

* cited by examiner

IMAGE FORMING DEVICE HAVING DETACHABLE DRUM UNIT

CROSS REFERENCE TO RELATED APPLICATION

This application is a continuation application of U.S. Ser. No. 12/359,720 filed on Jan. 26, 2009 and claims priority from Japanese Patent Application No. 2008-017602 filed Jan. 29, 2008. The entire contents of each of which are incorporated herein by reference.

TECHNICAL FIELD

The present invention relates to an electrophotographic image forming device that forms images on recording sheets.

BACKGROUND

In a direct-tandem color laser printer disclosed in Japanese patent publication no. 2006-98776, after a pair of registration rollers has corrected skew in a sheet conveyed from a feeding tray, the corrected sheet is then conveyed to a drum unit (image forming unit) including a plurality of photosensitive drums.

In the above-mentioned invention, the drum unit is designed to be removable from the main casing, thereby enabling the photosensitive drums to be removed all at once from the main casing. Thus, this configuration facilitates maintenance of the drum unit.

Generally, the registration rollers are designed to correct skew in recording sheets, such as sheets of paper, as described above. The registration rollers are, therefore, preferably disposed in as close proximity to the drum unit as possible.

This is because, if the registration rollers are disposed in a position far away from the drum unit, a recording sheet may become skewed again before reaching the drum unit, even though the registration rollers had previously registered the sheet before conveying the sheet downstream. Another reason is that it is difficult to control the timing at which the registration rollers supply a recording sheet to the drum unit with a high degree of accuracy.

On the other hand, if the registration rollers are disposed in proximity to the drum unit, the registration rollers and the drum unit may interfere with each other when the drum unit is being removed from the main casing simply by being pulled out in a horizontal direction. In such a case, it may not be easy to remove the drum unit from the main casing.

In the invention disclosed in the above-identified publication, therefore, one of the registration rollers located closer to the drum unit is provided in the drum unit. According to this configuration, when the drum unit is being removed from the main casing, one of the registration rollers is removed together with the drum unit, thereby preventing interference between the registration rollers and the drum unit from occurring.

As stated, a pair of registration rollers is provided for correcting skew in recording sheets, and, hence, one registration roller must be positioned relative to the other registration roller with a high degree of accuracy. However, as in the above-identified reference, when one of the registration rollers is configured to be removed together with the drum unit and the other registration roller is fixed to the main casing, it is difficult to achieve high positioning accuracy between the pair of registration rollers.

Moreover, although another method may be employed to prevent interference between registration rollers and a drum unit by incorporating one of the registration rollers in a cover that opens/closes an opening for removing/mounting the drum unit, high positioning accuracy between the pair of registration rollers is still difficult to achieve, because one of the registration rollers is fixed to a movable unit while the other one is fixed to a main casing, as in the invention identified above.

Further, high positioning accuracy between the registration rollers may be achieved even in the above-mentioned method if the movable, open/close cover is given high rigidity. However, this solution inevitably increases the weight and dimensions of the open/close cover, leading to a larger image forming device.

In view of the forgoing, it is an object of the present invention to provide an image forming device that can be made compact and can realize easy removal of a drum unit while achieving high positioning accuracy between a pair of registration rollers.

SUMMARY

The present invention is made in order to achieve the above and other objects. According to an aspect of the present invention, there is provided an electrophotographic image forming device that forms images on recording sheets. The image forming device includes a frame having an opening, a cover movable for opening and closing the opening, a drum unit, a belt unit and a pair of registration rollers. The drum unit is disposed in the frame and having a plurality of photosensitive drums each defining an axis, the plurality of photosensitive drums being juxtaposed in line in a direction orthogonal to the axis. The belt unit is accommodated in the frame and having a plurality of rollers and an endless belt mounted over the plurality of rollers under tension, the endless belt having a first running part running in a sheet conveying direction and in direct confrontation with each of the photosensitive drums, the first running part extending in a first direction, the drum unit being movable in the first direction and accessible through the opening. The pair of registration rollers nips the recording sheets therebetween to correct skew in the recording sheets and to convey each recording sheet toward the belt unit, the pair of registration rollers being supported to the frame and disposed at a side opposite to the drum unit with respect to an imaginary plane which is an extension of the first running part, the pair of registration rollers defining a nip point therebetween where the recording sheet is nipped, the nip point being located at a position aligned with the belt unit.

According to another aspect of the invention, there is provided an electrophotographic image forming device that forms images on recording sheets, which includes a frame having an opening, a cover movable for opening and closing the opening, a drum unit, a belt unit and a pair of registration rollers. The drum unit is disposed in the frame and having a plurality of photosensitive drums each defining an axis, the plurality of photosensitive drums being juxtaposed in line in a direction orthogonal to the axis. The belt unit is accommodated in the frame and having a plurality of rollers and an endless belt mounted over the plurality of rollers under tension, the endless belt having a first running part running in a sheet conveying direction and in direct confrontation with each of the photosensitive drums, the first running part extending in a first direction, the drum unit being movable relative to the belt unit in the first direction and accessible through the opening. The pair of registration rollers nips the recording sheets therebetween to correct skew in the recording sheets and to convey each recording sheet toward the belt unit, the pair of registration rollers being supported to the frame and disposed at a side opposite to the drum unit with respect to an imaginary plane which is an extension of the first running part.

BRIEF DESCRIPTION OF THE DRAWINGS

The particular features and advantages of the invention as well as other objects will become apparent from the following description taken in connection with the accompanying drawings, in which.

DETAILED DESCRIPTION

An electrophotographic image forming device of the present invention is applied to a direct tandem color laser printer in the present embodiment. Hereinafter, the present embodiment will be described with accompanying drawings.

Figure 2:
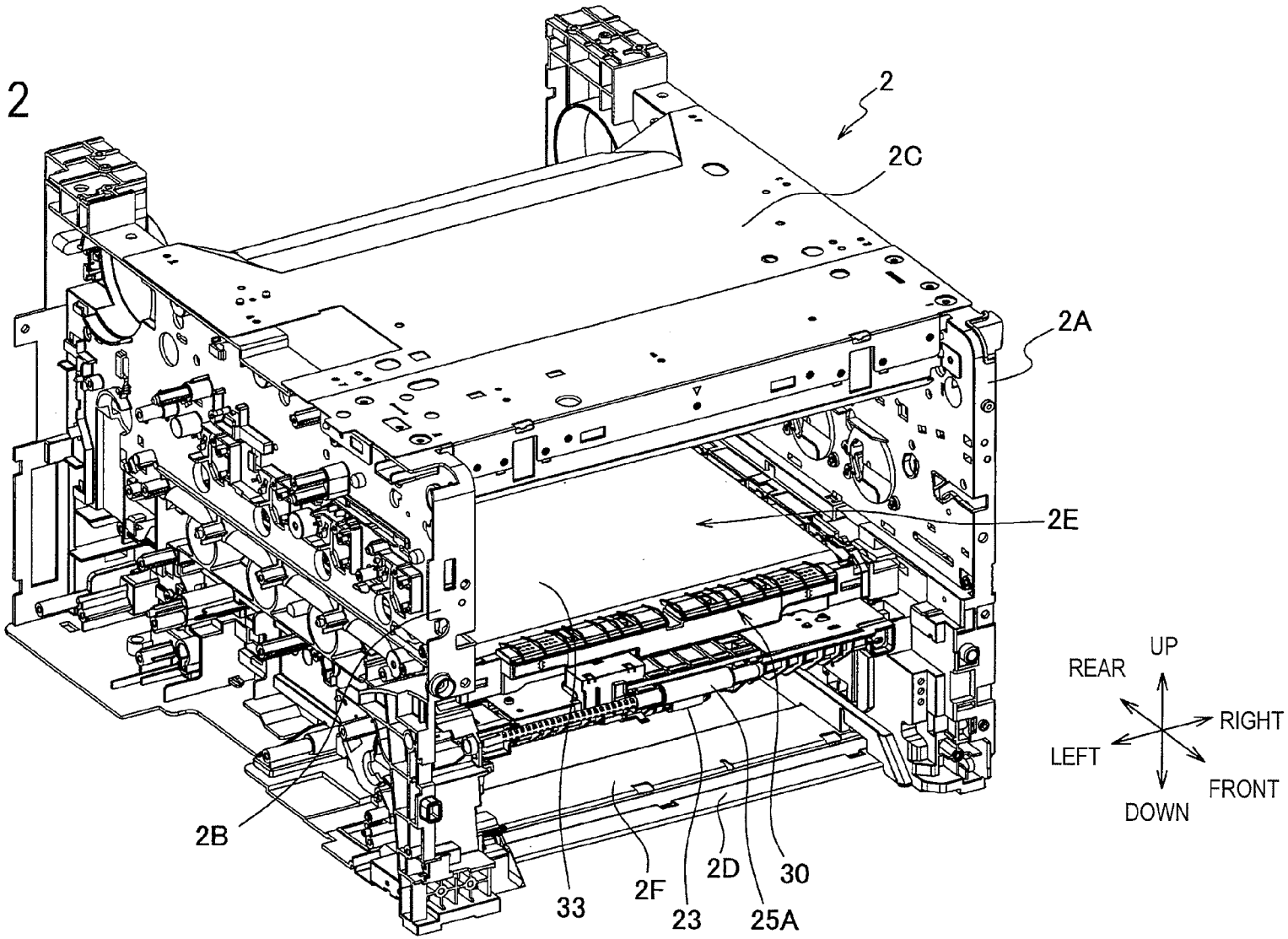
FIG. 2 is a perspective view from the left side of the main body (frame) 2 of the image forming device 1.

A main body (frame) 2 shown in FIG. 2 is covered with a casing 3. On the upper surface of the casing 3 located is a discharge tray 4 onto which a plurality of sheets of paper or transparencies (hereinafter simply referred to as sheets) is discharged from the casing 3 after printing (image formation) has finished.

As shown in FIG. 2, the main body 2 includes substantially plate-shaped side frames 2A and 2B, a top plate 2C, and a bottom plate 2D. The side frames 2A and 2B are disposed at both ends of the main body 2 in a horizontal (left-to-right) direction, and the top plate 2C connects the two side frames 2A and 2B at the upper ends thereof, while the bottom plate 2D connects the two side frames 2A and 2B at the lower ends thereof. Note that a pair of registration rollers 26A and 26B described later is omitted in FIG. 2.

Figure 1:
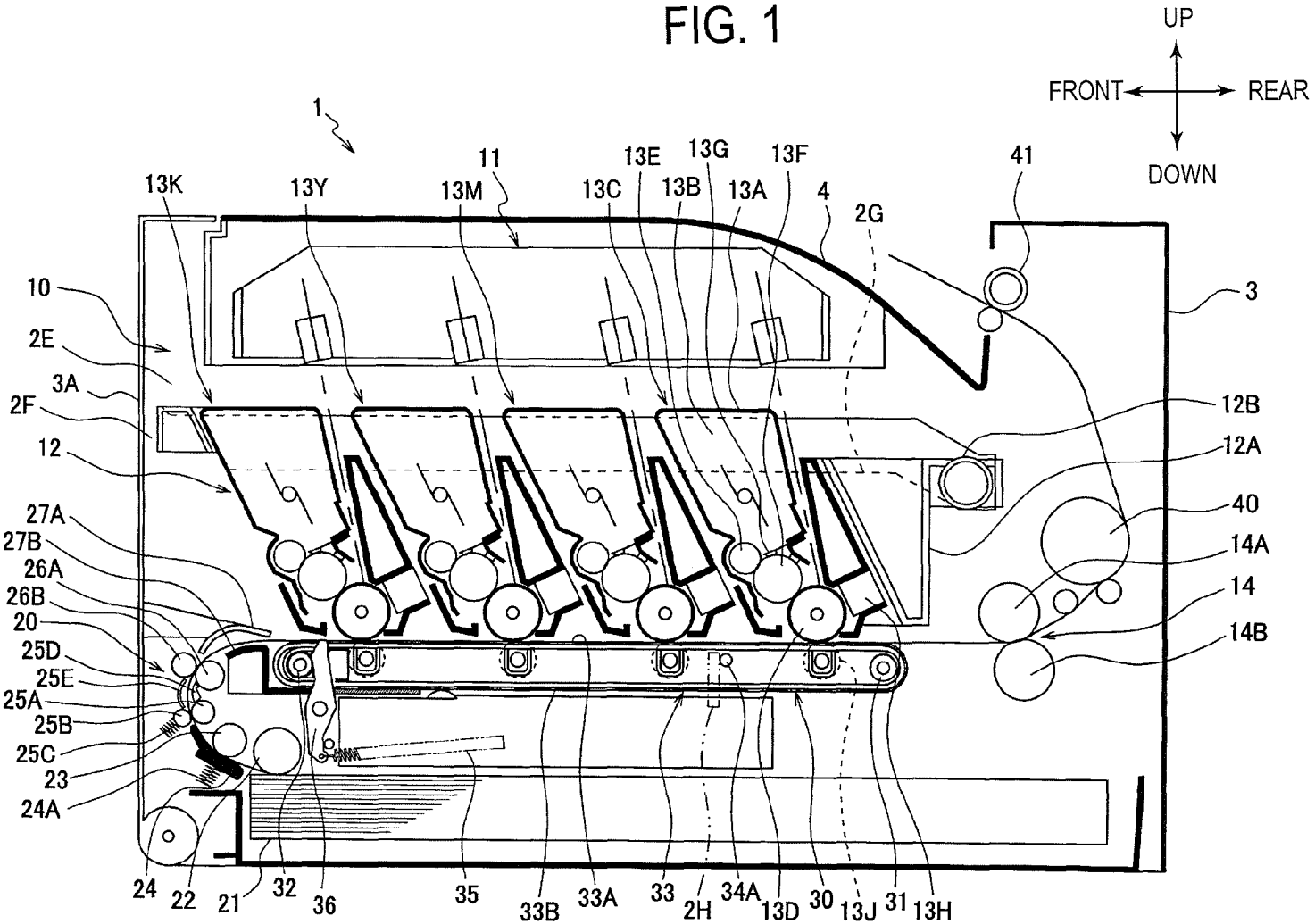
FIG. 1 is a cross-sectional view showing main parts of the image forming device 1 according to the present embodiment.
Figure 5:
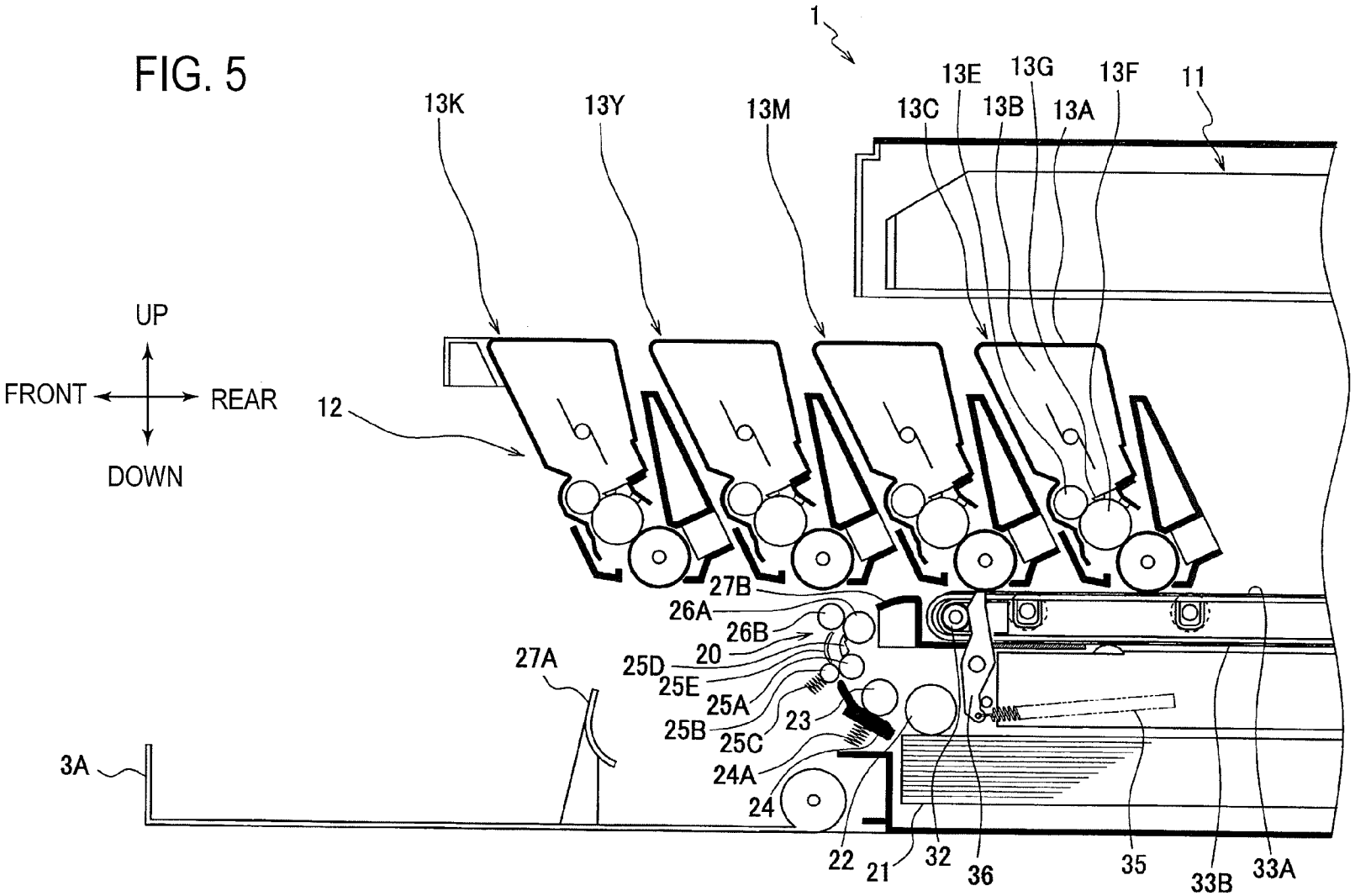
FIG. 5 is a view showing detachment of the photosensitive unit 12.

The main body 2 has an accommodation space 2E that extends in a front-to-rear direction with the left-right sides thereof bounded by the side frames 2A and 2B. As shown in FIGS. 1 and 5, an opening 2F provided at the front side of the accommodation space 2E can be opened or closed by a door 3A that is pivotably attached to the casing 3.

An image forming unit 10 including a drawer unit or the like, a feeder unit 20, and a belt unit 30 are provided within the accommodation space 2E of the main body 2. After the image forming unit 10 has formed images on a sheet, an intermediate conveying roller 40 conveys the sheet along a discharging chute (not shown) that guides the sheet first upward and then forward so that the conveying direction changes substantially 180 degrees. Finally, a discharge roller 41 discharges the sheet onto the discharge tray.

As shown in FIG. 1, the image forming unit 10 includes an exposing unit (scanner) 11, a photosensitive unit 12, a fixing unit 14, and the like.

In the image forming unit 10 according to the present embodiment, four developer cartridges 13K, 13Y, 13M and 13C are juxtaposed in line along the sheet conveying direction in order from the upstream side thereof. The four developer cartridges 13K, 13Y, 13M and 13C respectively correspond to four colors of developer (toner): black, yellow, magenta, and cyan. Each of the four colors of developer is sequentially superimposed onto a sheet while the sheet is being conveyed on the belt unit 30.

The exposing unit 11 is disposed in the upper portion of the casing 3. The exposing unit 11 serves to form electrostatic latent images on the surface of a photosensitive unit 13D (described later), and specifically includes a laser source, a polygon mirror, an fθ lens, and reflection mirrors.

The laser beam emitted from the laser source according to image data is deflected and scanned by the polygon mirror, passes through the fθ lens, reverses directions along a different optical path when reflected by a reflection mirror, and then follows a downward path when reflected by another reflection mirror. The laser beam is finally irradiated onto the surface of the photosensitive drum 13D on which electrostatic latent images are formed.

The photosensitive unit 12 has four developer cartridges 13K, 13Y, 13M and 13C (hereinafter collectively referred to as developer cartridges 13). The developer cartridges 13 are accommodated in a drawer casing 12A capable of moving in the front-to-rear direction with respect to the main body 2. The developer cartridges 13 and the drawer casing 12A that accommodates the developer cartridges 13 integrally constitute a drawer unit (drum unit).

Hence, in this embodiment, four developer cartridges (the developer cartridges 13) can be integrally removed from/mounted on the main body 2. A guide roller 12B is provided with the drawer casing 12A (photosensitive unit 12) at the advancing side in the mounting direction of the drawer casing 12A (i.e., rear side) with respect to the main body 2. A guide rail 2G is in sliding contact with the guide roller 12B to guide the photosensitive unit 12 into the correct mounting position thereof.

Note that black developer is accommodated in the developer cartridge 13K, yellow developer in the developer cartridge 13Y, magenta developer in the developer cartridge 13M, and cyan developer in the developer cartridge 13C.

Also note that all of the four developer cartridges have the same configuration except in that each accommodates developers of a different color. Details of the configuration of the developer cartridges are as described below.

A developer accommodating unit 13A includes a developer accommodating chamber 13B that accommodates developer, a supplying roller 13E that supplies developer onto the photosensitive drum 13D, and a developing roller 13F and the like. The developer accommodated in the accommodating chamber 13B is supplied to the developing roller 13F side in accordance with the rotation of the supplying roller 13E, then carried on the surface of the developer roller 13F while the thickness of the carried developer is adjusted to a constant prescribed thickness by a thickness-regulating blade 13G, and finally supplied onto the surface of the photosensitive drum 13D exposed by the exposing unit 11.

The photosensitive drum 13D serves to carry images to be transferred onto sheets. The photosensitive drum 13D is provided in each of the four developing cartridges. The four photosensitive drums 13D are juxtaposed in line in a direction orthogonal to the axial direction thereof, that is, in the sheet conveying direction.

A charger 13H serves to charge the surface of the photosensitive drum 13D. A transferring roller 13J is disposed in opposition to the photosensitive drum 13D via the conveying belt 33. The transferring roller 13J applies to sheets a voltage having a polarity opposite the charge generated on the surface of the photosensitive drum 13D when the sheets pass in the vicinity of the photosensitive drum 13D, and transfers developer carried on the surface of the photosensitive drum 13D onto the printing surfaces of the sheets.

In the present embodiment, the transferring roller 13J is rotatably provided in the belt unit 30, and arranged so as to be in contact with the back side of the conveying belt 33. The transferring roller 13J rotates along with the movement of the conveying belt 33.

A fixing unit 14 is disposed downstream of the photosensitive drum 13D in the sheet conveying direction. The fixing unit 14 heats and melts the developer transferred onto the sheets for fixation, and is detachably mounted on the main body 2.

Specifically, the fixing unit 14 includes a heating roller 14A, a pressure roller 14B, and the like. The heating roller 14A is disposed on the printing surface side of the sheet, and applies a conveying force to the sheet while heating the developer thereon. The pressure roller 14B is disposed in confrontation with the heating roller 14A via the sheet, and presses the sheet against the heating roller 14A side.

A belt unit 30 works in conjunction with the operation of the photosensitive unit 12 to convey sheets. As shown in FIG. 1, the belt unit 30 is disposed in a position below the photosensitive unit 12, and detachably mounted in the main body 2.

The belt unit 30 includes a drive roller 31, a follow roller (tension roller) 32, a conveying belt that is mounted in a taut state on the drive roller 31 and the follow roller 32, and a belt unit frame 34 (see FIG. 3) that supports the drive roller 31 and the follow roller 32. The drive roller 31 is configured to rotate in conjunction with the rotation of the photosensitive drum 13D. The follow roller 32 is rotatably disposed in a position distanced from the drive roller 31. The conveying belt 33 has a first conveying portion 33A (upper portion) that confronts each of the photosensitive drums 13D.

The first conveying portion 33A is a surface on which each sheet is placed and conveyed. The photosensitive unit 12 can be moved in a direction parallel to the plane of the first conveying portion 33A, i.e., a direction that passes through the rotational centers of the drive roller 31 and the follow roller 32 (in this embodiment, the front-to-rear direction). That is, the photosensitive unit 12 is detachably mounted in the main body 2 with respect to the extending direction of the first conveying portion 33A (the front-to-rear direction) in this embodiment.

Figure 6:
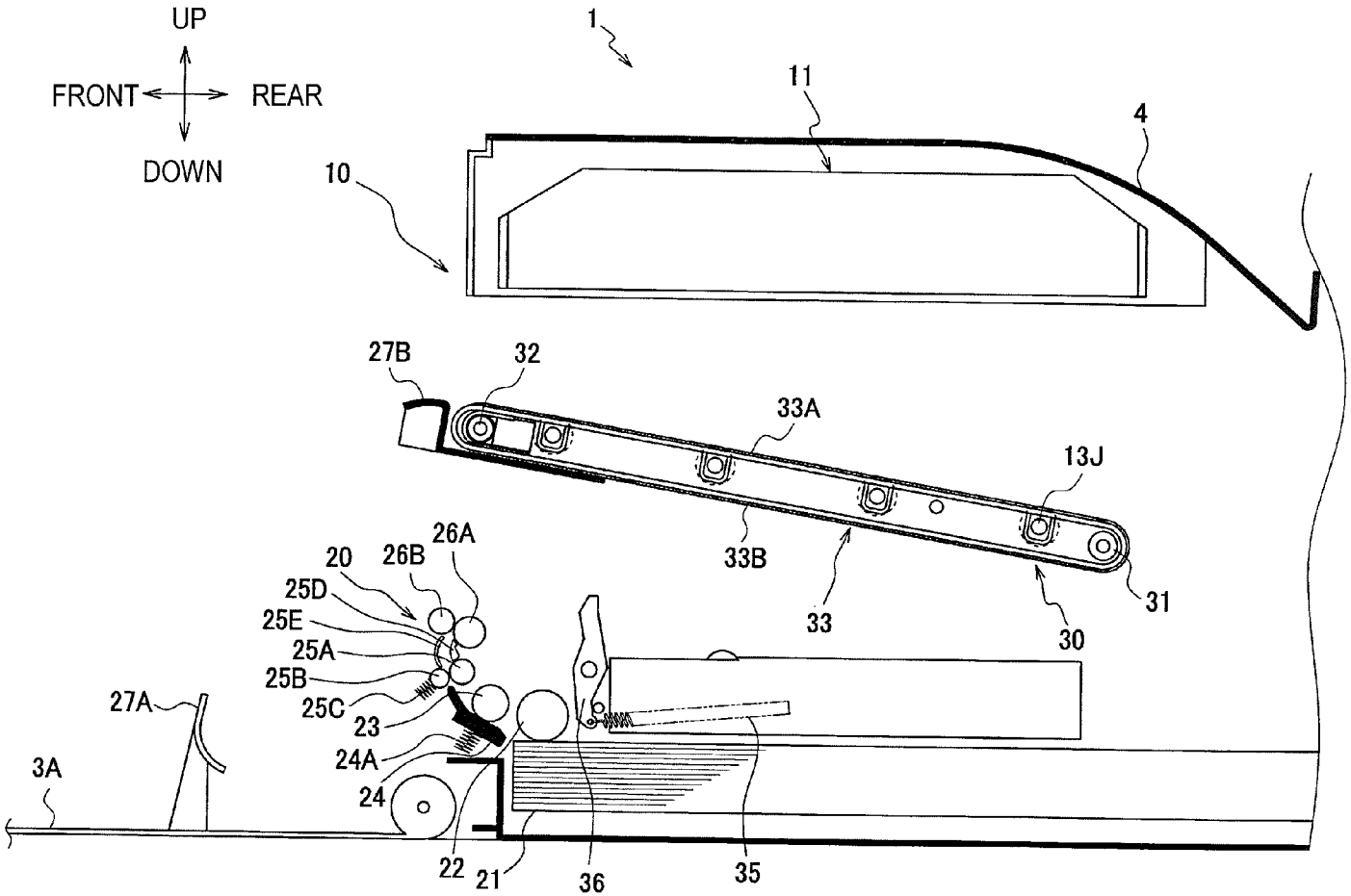
FIG. 6 is a view showing detachment of the belt unit 30.

When the photosensitive unit 12 is removed, as shown in FIG. 6, the belt unit 30 can then be taken out from the main body 2 by lifting the front end portion of the belt unit 30 upward and thus releasing from a tension lever 36 (to be described later).

The rotational shaft of the drive roller 31 is rotatably assembled on the belt unit frame 34 at a fixed position with respect to the same via a bearing (not shown).

The rotational shaft of the follow roller 32, on the other hand, is provided with bearings (not shown) at the axial ends thereof and is assembled on the belt unit frame 34 in such a manner that the rotational shaft can be inserted into elongated holes (not shown) formed in the belt unit frame 34. With this construction, the rotational shaft can be displaced in a direction toward or away from the drive roller 31.

When the belt unit 30 is mounted in a correct mounting position with respect to the main body 2, as shown in FIG. 1, a biasing member such as a coil spring 35 applies a biasing force to the follow roller 32 via the tension lever 36, pushing the follow roller 32 in a direction away from the drive roller 31.

As shown in FIG. 1, the belt unit 30 (belt unit frame 34) has protrusions 34A that protrude to the side frames 2A and 2B constituting a part of the main body 2. On the side frames 2A and 2B, engaging portions 2H are provided for engaging with the protrusions 34A at the follow roller 32 side thereof, when the belt unit 30 is placed in the correct mounting position with respect to the main body 2.

Accordingly, when the belt unit 30 is placed in the correct mounting position with respect to the main body 2, the engagement with the protrusions 34A and the engaging portions 2H can prevent the belt unit 30 from moving toward the follow roller 32 side, and the biasing force applied from the tension lever 36 can transmit a prescribed tension from the follow roller 32 to the conveying belt 33.

Note that the correct mounting position refers to a position at which the belt unit 30 can operate normally. If the belt unit 30 is not mounted in the correct mounting position, the sheets cannot be conveyed normally, thereby leading to a degradation in the quality of images formed on the sheets, or occurrence of paper jams and the like while the sheet is being conveyed.

A feeder unit 20 serves to convey sheets stacked in a sheet feeding tray 21 (described later). More particularly, as shown in FIG. 1, the feeder unit 20 includes a sheet feeding tray 21, a pick-up roller 22, a sheet feeding roller 23 and the like. The sheet feeding tray 21 is disposed in the lowest portion of the main body 2, and a plurality of sheets is accommodated therein in a stacked state. The pick-up roller 22 picks up a sheet from among the sheets stacked in the sheet feeding tray 21. The sheet feeding roller 23 feeds (conveys) the sheet picked up by the pick-up roller 22 to the image forming unit 10 side.

A separating pad 24 is disposed in confrontation with the sheet feeding roller 23 with sheets being conveyed therebetween. The separating pad 24 serves to prevent a plurality of sheets from being conveyed at a time by applying a predetermined resistance to a conveyed sheet, enabling only one sheet that touches the sheet feeding roller 23 to be conveyed.

Note that the separating pad 24 is assembled on the sheet feeding tray 21, and a biasing member, such as a coil spring 24A, applies a biasing force to the separating pad 24, pressing the separating pad 24 against the sheet feeding roller 23. On the other hand, the sheet feeding roller 23 is rotatably assembled on the main body 2. The pick-up roller 22 is assembled on a tip portion of a pivoting arm (not shown) that is pivotably assembled on the main body 2.

Figure 4:
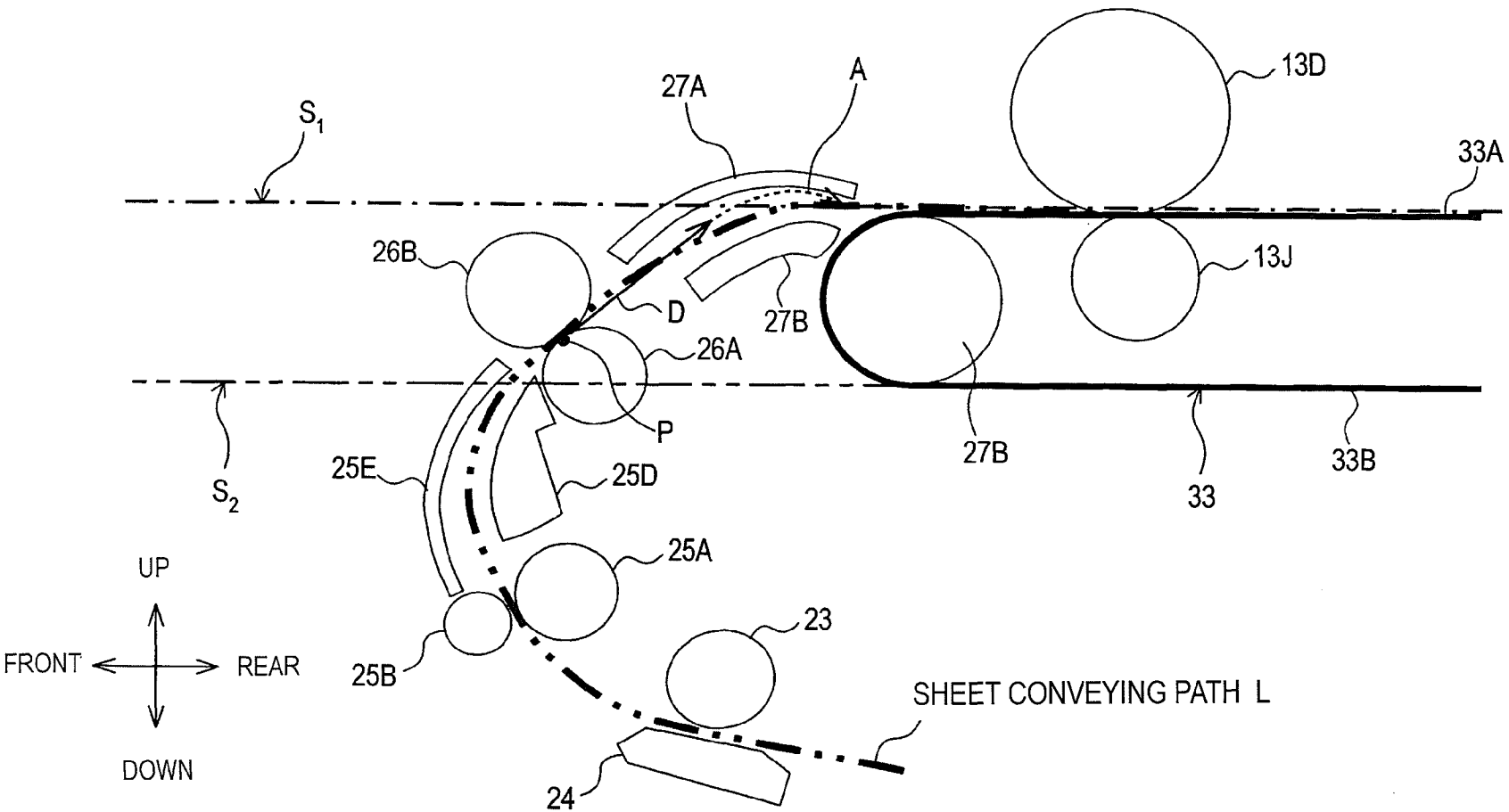
FIG. 4 is a diagram illustrating the relationships of disposition between registration rollers 26A and 26B and the belt unit 30.

As shown in FIG. 4, a pair of conveying rollers 25A and 25B is provided downstream of the sheet feeding roller 23 in the conveying direction for conveying sheets to the pair of registration rollers 26A and 26B.

Note that the conveying roller 25A is rotatably assembled on the main body 2, while the conveying roller 25B is rotatably assembled on the sheet feeding tray 21. A biasing member, such as a coil spring 25C, applies a biasing force to the conveying roller 25B, pressing the conveying roller 25B to the conveying roller 25A (see FIG. 1).

The registration rollers 26A and 26B convey sheets to the belt unit 30 and also serve to correct skew in the conveyed sheets. The registration rollers 26A and 26B are rotatably supported in the main body 2 at both axial ends thereof, and are disposed on the opposite side of an imaginary plane S1 that includes the first conveying portion 33A of the conveying belt 33 from the photosensitive unit 12 (i.e., below the imaginary plane S1 in this embodiment).

The registration rollers 26A and 26B pinch each sheet at a nip point P, which is located at a position aligned with the belt unit 30 in the extending direction of the belt unit 30 (the front-to-rear direction in this embodiment). That is, the nip pint P is positioned in a space formed between the imaginary plane S1 and an imaginary plane S2 that includes a second conveying portion 33B (lower portion of the conveying belt 33) located in opposition to the first conveying portion 33A via the follow roller 32.

Guides 25D and 25E serve to guide sheets conveyed out of the pair of conveying rollers 25A and 25B along a U-shaped path that runs upward and rearward toward the pair of registration rollers 26A and 26B. Hence, the guides 25D and 25E change the sheet conveying direction substantially 180 degrees.

Note that, because the registration rollers 26A and 26B are both disposed in a position opposing the photosensitive unit 12 with respect to the imaginary plane S1, as shown in FIG. 4, the tangential direction of the nip point P, i.e., a conveying direction D of the sheets conveyed from the registration rollers 26 A and 26B inevitably intersects with the imaginary plane S1.

Hence, in this embodiment, a first guide 27A and a second guide 27B are provided for guiding the sheets conveyed from the registration rollers 26A and 26B toward the conveying belt 33.

A sheet conveying path L is formed from the sheet feeding tray 21 to the belt unit 30 and is substantially U-shaped. The first guide 27A is disposed in a position opposing to the center of curvature of the sheet conveying path L and serves to change the sheet conveying direction toward the center of curvature. The first guide 27A is assembled on the door 3A, and therefore, as shown in FIGS. 5 and 6, is displaced mechanically in association with the (opening/closing) movement of the door 3A.

Figure 3:
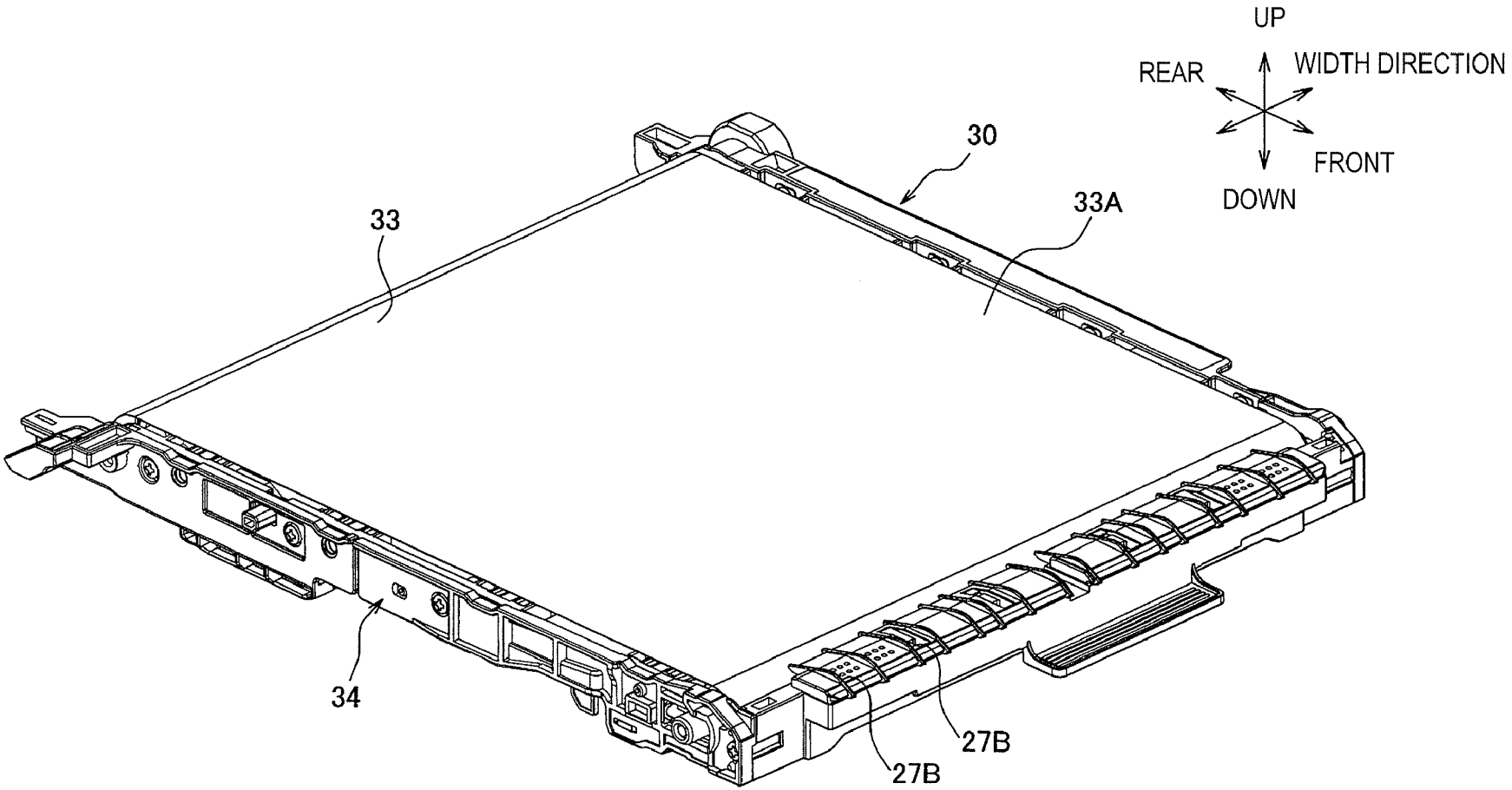
FIG. 3 is a perspective view of a belt unit 30.

As shown in FIG. 4, the second guide 27B is disposed in confrontation with the first guide 27A via the sheet conveying path L and serves in cooperation with the first guide 27A to guide the sheets conveyed from the registration rollers 26A and 26B toward the conveying belt 33. The second guide 27B is provided in the belt unit 30, as shown in FIG. 3.

Note that the circumferential velocity of the registration rollers 26A and 26B is set to be greater than the moving velocity of the conveying belt 33. Accordingly, when a leading edge of a conveyed sheet reaches the conveying belt 33, a conveying force generated by the registration rollers 26A and 26B urges the sheet to curl so that the curved part protrudes toward the opposite side of the sheet conveying path L from the center of curvature.

Hence, in this embodiment, as shown in FIG. 4, at least a portion of the first guide 27A is arranged to be located on the same side of the imaginary plane S1 as the photosensitive unit 12, as well as to turn the sheet conveying direction toward the conveying belt 33 from the photosensitive unit 12 side of the imaginary plane S1.

That is, as indicated by the dotted line A in FIG. 4, once a sheet conveyed from the registration rollers 26A and 26B reaches the photosensitive unit 12 side beyond the imaginary plane S1, the first guide 27A changes the conveying direction of the sheet toward the imaginary plane S1, and subsequently guides the sheet to the conveying belt 33.

Because the circumferential speed of the pair of registration rollers is larger than the moving speed of the conveying belt, a sheet goes slack between the registration rollers 26A and 26B and the conveying belt 33, thereby enabling the sheet to be in close contact with the conveying belt 33.

In the present invention, the registration rollers 26A and 26B are supported in the main body 2 and disposed at the opposite side of the photosensitive unit 12 with respect to the imaginary plane S1. This configuration can contribute to downsizing of the image forming device 1, while achieving high positioning accuracy between the pair of registration rollers 26A and 26B.

Also, since the pair of registration rollers is disposed on the opposite side of the imaginary plane S1 from the photosensitive unit 12, interference between the registration rollers 26A and 26B and the photosensitive unit 12 can be prevented when the photosensitive unit 12 is to be removed from the main body 2, as shown in FIG. 5.

Moreover, since the nip point P of the pair of registration rollers 26A and 26B is located in a position aligned with the belt unit 30 in the extending direction of the belt unit 30 (the front-to-rear direction), as shown in FIG. 4, the registration rollers 26A and 26B can be disposed in the vicinity of the photosensitive unit 12. Accordingly, the registration rollers 26A and 26B can reliably correct skew generated in sheets to be supplied to the photosensitive unit 12, and can control the timing at which the sheets are supplied to the photosensitive unit 12 with great accuracy.

Hence, in this embodiment, the photosensitive unit 12 can be easily detached from the main body 2, while the overall size of the image forming device 1 can be made compact and the positioning accuracy between the pair of registration rollers 26A and 26B can be highly maintained.

Further, in this embodiment, the first guide 27A and the second guide 27B are provided for guiding the sheets sent from the pair of registration rollers 26A and 26B to the conveying belt 33, thereby ensuring that the sheets be conveyed to the photosensitive unit 12.

The first guide 27A is arranged so as to be displaced along with the opening/closing operations of the door 3A, thereby avoiding interference with the photosensitive unit 12 when the photosensitive unit 12 is removed from the main body 2.

The first guide 27A is also configured to separate from the second guide 27B when the door 3A is opened, thereby facilitating removal of jammed papers even when a paper jam occurs around the first guide 27A.

Note that the first guide 27A serves to change the sheet conveying direction in order to guide the sheet toward the photosensitive unit 12, and therefore, does not require the same positioning accuracy required for the registration rollers 26A and 26B. Hence, changing positions of the first guide 27A affects the image formation by the image forming device 1 very little.

The second guide 27B is designed to remain stationary even when the door 3A is opened, since the second guide 27B is disposed on the belt unit 30. As shown in FIG. 4, the second guide 27B is disposed on the opposite side of the imaginary plane S1 from the photosensitive unit 12, i.e., below the imaginary line S1. Accordingly, this configuration prohibits the second guide 27B from interfering with the photosensitive unit 12 when the photosensitive unit 12 is being detached from the main body 2.

Further, in the present embodiment, the pair of registration rollers 26A and 26B sends out sheets in a direction that intersects with the imaginary plane S1, and the first guide 27A changes the conveying direction of the sheets conveyed from the registration rollers 26A and 26B toward the conveying belt 33 on the photosensitive unit 12 side of the imaginary plane S1. Because of this configuration, the conveying path of the sheets conveyed from the registration rollers 26A and 26B (the dotted line A in FIG. 4) first crosses the imaginary plane 51, and then approaches the first conveying portion 33A of the conveying belt 33 at an acute angle. Hence, the air existing between each sheet and the conveying belt 33 can be effectively expelled, thereby enabling the sheet to be placed reliably on the conveying belt 33.

As a variation of the present embodiment, it is not necessary for the photosensitive unit 12 to be capable of moving (detaching) in the front-to-rear direction (i.e., substantially in the horizontal direction).

The belt unit 30 according to the present embodiment is provided for conveying sheets, but the belt unit 30 may instead be used for the intermediate transfer of developer.

As an alternative to the exposing device, a plurality of LED lights may be controlled and used to expose the photosensitive drums 13D, instead of using a scanner that employs laser beams.

Although the present invention has been described with respect to specific embodiments, it will be appreciated by one skilled in the art that a variety of changes may be made without departing from the spirits of the invention.

What is claimed is:

1. An electrophotographic image forming device that forms images on recording sheets, the image forming device comprising:

a frame having an opening;

a cover movable for opening and closing the opening;

a drawer movably disposed in the frame and supporting a plurality of photosensitive drums each defining an axis, the plurality of photosensitive drums being juxtaposed in line in a first direction orthogonal to the axis;

a belt unit accommodated in the frame and having a plurality of rollers and an endless belt mounted over the plurality of rollers under tension, the endless belt having a first running part running in a sheet conveying direction and in direct confrontation with each of the photosensitive drums, a guide member that guides the drawer through the opening such that the drawer supporting the plurality of photosensitive drums is movable in the first direction;

a pair of registration rollers that nips the recording sheets therebetween to correct skew in the recording sheets and to convey each recording sheet toward the belt unit, the pair of registration rollers being supported to the frame and disposed at a side opposite to the drawer supporting the plurality of photosensitive drums with respect to an imaginary plane which is an extension of the first running part, the pair of registration rollers defining a nip point therebetween where the recording sheet is nipped;

a first guide that guides the recording sheets conveyed from the pair of registration rollers toward the endless belt, the first guide having a guide portion located on a side the same as that of the drawer with respect to the imaginary plane for allowing a leading edge of the recording sheet to direct toward the endless belt; and a second guide positioned in confrontation with the first guide for guiding the recording sheets conveyed from the pair of registration rollers toward the endless belt in cooperation with the first guide.

2. The image forming device as claimed in claim 1, wherein the nip point is located at a position aligned with the belt unit in an extending direction of the belt unit.

3. The image forming device as claimed in claim 2, wherein the endless belt has a second running part running in a direction opposite to the sheet conveying direction, the nip point being positioned between the extension of the first running part and an extension of the second running part.

4. The image forming device as claimed in claim 1, wherein the pair of registration rollers provides a circumferential speed greater than a running speed of the endless belt.

5. The image forming device as claimed in claim 1, wherein the first guide is movable in interlocking relation to a movement of the cover.

6. The image forming device as claimed in claim 1, wherein the first guide is fixed to the cover.

7. The image forming device as claimed in claim 1, wherein the pair of registration rollers is configured to convey the recording sheets in a direction intersecting with the imaginary plane.

8. The image forming device as claimed in claim 1, wherein the guide portion is configured to allow the leading edge of each recording sheet to direct toward the endless belt with an acute angle.

9. The image forming device as claimed in claim 1, wherein the second guide is provided at the belt unit.

10. The image forming device as claimed in claim 1, wherein the belt unit is disposed in the frame such that the belt unit is removable from the frame.

11. An electrophotographic image forming device that forms images on recording sheets, the image forming device comprising:

a frame having an opening;

a cover movable for opening and closing the opening;

a drawer movably disposed in the frame and supporting a plurality of photosensitive drums;

a belt unit removably accommodated in the frame and having a plurality of rollers and an endless belt mounted over the plurality of rollers under tension, the endless belt having a first running part running in a sheet conveying direction and in direct confrontation with each of the photosensitive drums;

a pair of registration rollers that nips the recording sheets therebetween to correct skew in the recording sheets and to convey each recording sheet toward the belt unit, the pair of registration rollers being supported to the frame such that the belt unit is removable from the frame when the pair of registration rollers remains supported to the frame, the pair of registration rollers disposed at a side opposite to the drawer with respect to an imaginary plane which is an extension of the first running part;

a first guide that guides the recording sheets conveyed from the pair of registration rollers toward the endless belt, the first guide having a guide portion located on a side the same as that of the drawer with respect to the imaginary plane for allowing a leading edge of the recording sheet to direct toward the endless belt, the first guide being provided at the cover; and a second guide positioned in confrontation with the first guide for guiding the recording sheets conveyed from the pair of registration rollers toward the endless belt in cooperation with the first guide, the second guide being provided at the belt unit.

* * * * *